United States Patent [19]

De Pamphilis

[11] 4,167,796

[45] Sep. 18, 1979

[54] MULTIPURPOSE CLEANING AND POLISHING BRUSH

[76] Inventor: Richard L. De Pamphilis, 38 Sterling Rd., Hyannis, Mass. 02601

[21] Appl. No.: 935,147

[22] Filed: Aug. 21, 1978

[51] Int. Cl.[2] ..... A46B 11/00; A46B 17/00

[52] U.S. Cl. ..... 15/114; 15/106; 15/248 R

[58] Field of Search ..... 15/105, 105.52, 106, 15/107, 111, 113–115, 116 A, 117, 248 R; 401/24, 27, 38, 39

[56] References Cited

U.S. PATENT DOCUMENTS

| | | | |
|---|---|---|---|
| D. 105,362 | 7/1937 | Connor | D4/17 |
| D. 111,003 | 8/1938 | Partridge et al. | D4/6 |
| D. 130,254 | 11/1941 | Racicot | D4/35 |
| 118,638 | 8/1871 | Owen | 401/38 |
| 437,175 | 9/1890 | Darling | 401/38 |
| 1,501,020 | 7/1924 | Small | 15/248 R |
| 2,722,703 | 11/1955 | Green | 15/248 R X |
| 3,340,556 | 9/1967 | Allen | 15/159 R |

FOREIGN PATENT DOCUMENTS

| | | | |
|---|---|---|---|
| 102640 | 11/1937 | Australia | 15/111 |
| 872747 | 4/1953 | Fed. Rep. of Germany | 15/114 |
| 21179 | of 1904 | United Kingdom | 15/443 |
| 14086 | of 1909 | United Kingdom | 15/114 |
| 716422 | 10/1954 | United Kingdom | 15/244 R |
| 812076 | 4/1959 | United Kingdom | 15/114 |

*Primary Examiner*—Daniel Blum

*Attorney, Agent, or Firm*—Richard P. Crowley

[57] ABSTRACT

A brush apparatus for the cleaning and polishing of a surface having the advantages of an elongated handle with two or more spaced-apart, raised elastomeric rings to stop the flow of cleaning liquid onto the handle and onto the hand of the user.

The head of the brush is tapered and holds an abrasive-resistant foam or bristle rubbing pad to ease the removal of spots that otherwise would be difficult to clean. The ends of the bristles of the brush are feathered to allow for greater pickup of dirt when used dry and for the gentle cleaning of large areas when wet.

6 Claims, 2 Drawing Figures

MULTIPURPOSE CLEANING AND POLISHING BRUSH

BACKGROUND OF THE INVENTION

Automotive vehicles are cleaned both by hand and by machine. Washing by hand often entails the use of a sponge which requires the user to immerse frequently his or her hands in water mixed with soap or detergent. The use of a sponge also limits the area that can be cleaned in any given stroke to the usually small size of the sponge and the reach of the user. A variety of other tools is necessary to clean off dust, dirt, ice, snow and leaves as well as for applying wax over the surface being cleaned and polished.

Mechanical car-washing equipment avoids such personal disadvantages to the user, but may not be as effective in thoroughly cleaning the vehicle. Abrasive bristles and unreliable equipment may also be potentially harmful to a vehicle. There are also many vehicles, such as boats and airplanes which cannot be accommodated by such mechanical washing equipment.

It is desirable to have a device and a method of cleaning such vehicles which avoid the disadvantages of mechanical washing equipment and which clean and protect the implement or craft without forcing the washer to have skin contact with the soap or detergent. It is also desirable to have a device which could clean faster, easier and more effectively than a sponge in addition to being able to clean dust, leaves, ice and snow from the implement or craft.

SUMMARY OF THE INVENTION

My invention relates to an apparatus designed to clean and protect an implement or vehicle and an improved method of doing the same. More particularly, my invention concerns an all-purpose cleaning and polishing apparatus designed basically to be used in the washing and cleaning of automotive vehicles, such as passenger cars, vans, trucks, fire engines, golf carts, buses, limousines, etc. It is also a useful device for washing and polishing boats, auto trailers, mobile homes and even airplanes.

My apparatus comprises a body having a head element and a handle element, the head element having a tapered front section with a rubbing pad secured thereto and a handle having encircling means between the handle and body elements to prevent water from reaching the handle element during use. The body element has a plurality of bristles secured thereto in brush form on one side and preferably the bristles having feathered ends to allow for easier pickup of dust and dirt when used dry and to provide a gentle action and large surface area during use when wet.

My apparatus makes it possible for the user to minimize contact with the cleaning water and detergent or soap by providing an elongated handle approximately 6 inches long which protrudes above the waterline of a pail or bucket commonly used in the washing of implements or such crafts as hereinbefore mentioned.

My apparatus makes it possible to clean three or four times the area which a sponge would clean with the same stroke and can clean grilles and other honeycombed or creviced areas with less effort than required by a sponge. My apparatus also permits a longer reach than a sponge. In addition my apparatus rinses out easily and cleanly without hand squeezing required by a sponge and therefore avoids rubbing in dirt or grease particles which may disturb the finish of the implement or craft being cleaned.

The angled front end of my brush is equipped with a rubbing pad for use in removing insects, dirt, oil or grease particles, etc. adhering to the surface to be cleaned. My brush permits removal of such debris without having the user wet his or her hands.

The handle of the apparatus is tapered to receive a scraper for use on icy windows or windshields. The abundance of long, feathered bristles facilitates the removal of snow, leaves or dust from the implement or craft being cleaned. My brush can be used not only as a washing tool, but also as a multipurpose tool to remove snow, ice, leaves, dust, dirt and grime. It is also designed to be used after the washing process to spread liquid wax over the cleaned implement or craft, thus completing the cleaning and polishing processes.

The head and handle may be made of a durable plastic or of hard wood, such as oak or birch or of any rigid material able to be adapted so as to hold bristles. The apparatus is made by drilling holes into the head of the apparatus and inserting a group of bristles into each hole. The bristles may be made of any suitable material and should be long enough to be efficient in the sweeping of dust, leaves, snow etc. The ends of the bristles may be split or unraveled for greater static electrical adherence by dust or dirt when used dry.

The nose of the brush head is tapered to permit easier use of the rubbing pad secured thereto, the rubbing pad made of any suitable material for removing material and debris which is not easily removed by washing alone. Typically the front end is angled, e.g. 30° to 60° and preferably 45°, from the axis of the body and at the front end of the brush so that in use the user may merely turn the handle to remove debris during the wet-washing process. The rubbing pad may be secured by any means, such as adhesives or where composed of tough short bristles be inserted in the body in the rubbing-pad area. The rubbing pad may be of any size or shape, but preferably is of an angular-type shape, such as a triangle or rhomboid, to permit use of the corners at various angles for particularly difficult adhering material. Generally the area is about 2 to 5 square inches, but may be larger when larger body elements are required. The rubbing pad may be composed of any abrasive-resistant, tough, resilient material, such as a device of urethane or elastomeric-rubber or polymer-foam material or of short, cropped, straight bristles of natural or synthetic material, such as nylon bristles.

Another feature of my brush tool is that raised encircling means are used about the forward end of the handle element to prevent water or cleaning solution from reaching the handle element during use. The means typically comprises one or preferably two or more spaced-apart encircling, raised ridges. In the preferred embodiment two or more resilient, elastomeric gasket elements, such as thick elastic bands, are slipped over the handle element in a spaced-apart relationship. The spaced area may vary, but typically is from about ½" to 1" in length and serves to entrap water or cleaning solution there and to permit the water to run off or drip from the brush without reaching the far end of the handle element.

My apparatus will be described and illustrated in its preferred embodiment; however, it is recognized that those persons skilled in the art may make certain changes and modifications in such illustrated embodiment, all of which are within the spirit and scope of my invention.

DESCRIPTION OF THE EMBODIMENTS

Figures 1, 2:
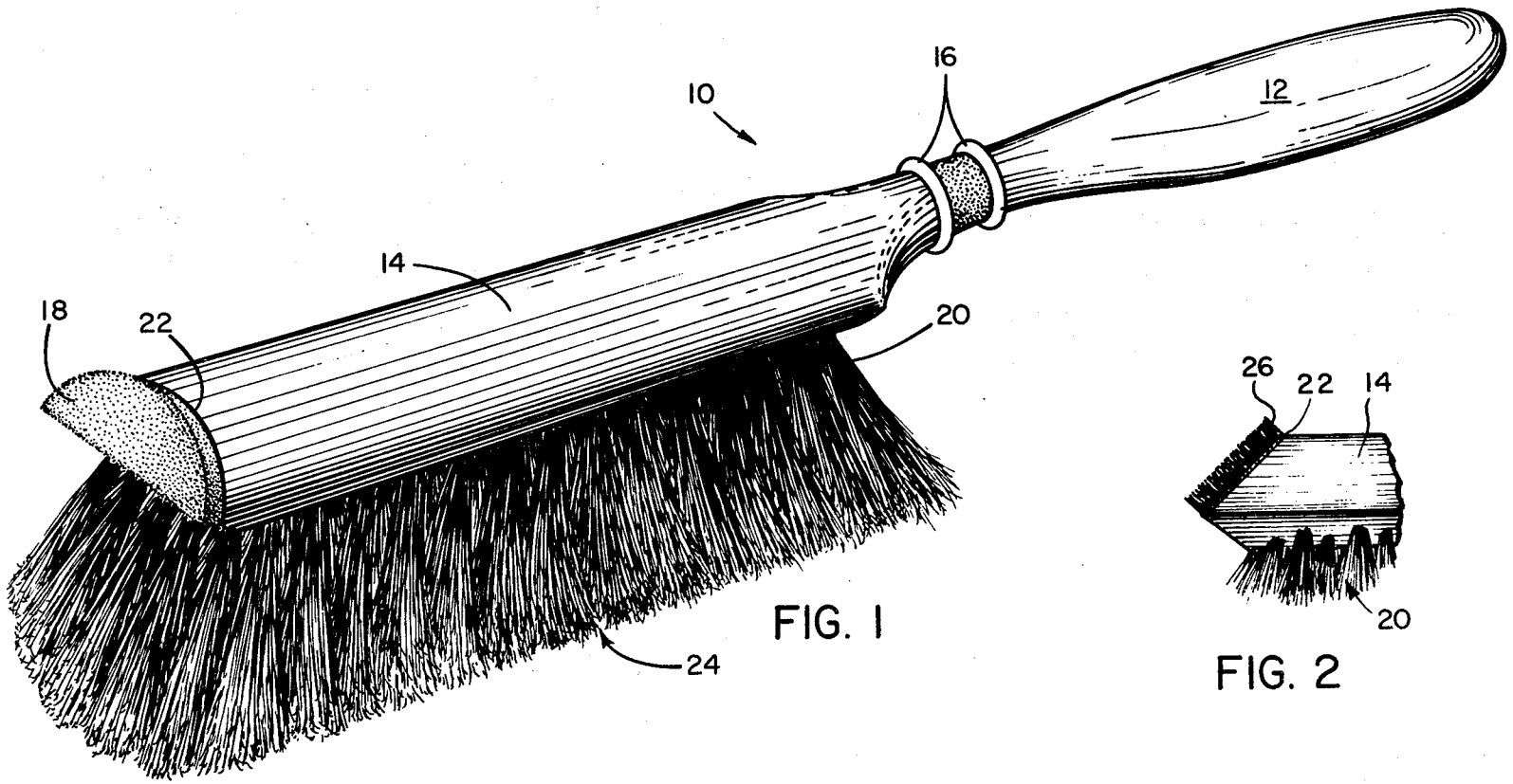
FIG. 1 is a perspective view of my apparatus.
FIG. 2 is an enlarged, fragmentary, cross-sectional view of a modification of my apparatus.

An all-purpose cleaning brush 10 comprises a head 14 and a handle 12 preferably of one piece, the handle 12 being tapered and elongated to protrude above the waterline of a pail or bucket commonly used in the washing of implements or crafts. The handle 12 has preferably a pair of spaced-apart, raised rubber rings 16 encircling the front portion of the handle and designed to impede the flow of water, detergent or other liquid down the handle 12 to minimize contact of such liquid with the user. A plurality of nylon bristles 20 is inserted or secured into holes drilled or cast in the head 14, which bristles are shown with split or unraveled ends 24.

The end of the brush head 14 is tapered preferably at an angle of 45° from the plane and axis of the head 14. This tapered edge holds a flat, tough, urethane-foam rubbing pad 18 secured to the tapered end by an adhesive layer 22. The adhesive should be waterproof glue or adhesive not subject to failure in water or alkaline cleaning solution, such as epoxy resins.

In FIG. 2 a modified rubbing pad is shown with the rubbing pad 26 made of short nylon bristles rather than of the foam of FIG. 1. The end of the handle 12 may likewise be tapered to receive a scraper blade (not shown) or other devices to ease the removal of snow and ice. The handle 12 is drilled with a ¼" drill bit to provide a hole for storage.

What I claim is:

1. A multipurpose cleaning brush, which brush comprises in combination:

(a) an elongated, brush, head element having a one end and another end and top and bottom sides;

(b) an elongated handle element having a one end and another end, the one end integral with, fixably secured and extending from the other end of the brush head;

(c) a plurality of bristles secured to and extending from and substantially the length of the bottom side of the brush head element, the bristles characterized by having feathered ends;

(d) the brush head element characterized by a generally angular-shaped area at the one end thereof, the area extending from and about the bottom side to the top side of the brush head element and at an angle of between about 30 to 60 degrees to the axis of the brush head element;

(e) a thin, flat, abrasion-resistant, polymeric-foam, rubbing pad secured to and substantially covering said area; and (f) raised, ridge-like, encircling means positioned generally at the one end of the handle element where it extends into the head element, to prevent the passage of water onto the handle element during use.

2. The cleaning brush of claim 1 wherein the polymeric-foam rubbing pad is adhesively secured to said area.

3. The cleaning brush of claim 1 wherein said area has an angle of about 45 degrees.

4. The cleaning brush of claim 1 wherein the raised, ridge-like, encircling means comprises one pair of elastomeric, spaced-apart, ring elements.

5. The cleaning brush of claim 1 wherein the said area comprises a generally arcuate-shaped area, with the arcuate shape extending along the top side of the head element.

6. The cleaning brush of claim 2 wherein the foam rubbing pad is a urethane foam which is adhesively secured by a waterproof, epoxy resin to said area.

* * * * *